United States Patent [19]

Whitehead et al.

[11] Patent Number: 5,036,909

[45] Date of Patent: Aug. 6, 1991

[54] MULTIPLE SERPENTINE TUBE HEAT EXCHANGER

[75] Inventors: Lee C. Whitehead, Middleport; James E. Farry, Jr., Williamsville, both of N.Y.

[73] Assignee: General Motors Corporation, Detroit, Mich.

[21] Appl. No.: 574,427

[22] Filed: Aug. 28, 1990

Related U.S. Application Data

[63] Continuation-in-part of Ser. No. 369,891, Jun. 22, 1989, abandoned.

[51] Int. Cl.[5] ..... F28D 1/00; F28F 13/08

[52] U.S. Cl. ..... 165/133; 165/146; 165/150; 165/174; 165/176; 165/152; 165/911; 62/525; 62/526

[58] Field of Search ..... 165/150, 174, 176, 146, 165/152, 177, 911; 62/525, 526

[56] References Cited

U.S. PATENT DOCUMENTS

| | | | |
|---|---|---|---|
| 3,416,600 | 12/1968 | Fink | 165/177 |
| 3,662,582 | 5/1972 | French | 165/177 |
| 3,776,018 | 12/1973 | French | 165/177 |

FOREIGN PATENT DOCUMENTS

| | | | |
|---|---|---|---|
| 0999598 | 2/1952 | France | 165/177 |
| 0198995 | 12/1982 | Japan | 165/152 |
| 0096986 | 6/1983 | Japan | 165/152 |
| 0205591 | 11/1984 | Japan | 165/152 |

*Primary Examiner*—John K. Ford
*Attorney, Agent, or Firm*—Ronald L. Phillips

[57] ABSTRACT

A multiple serpentine tube heat exchanger having side-by-side arranged serpentine-shaped passageways each extending across the core and a mixing chamber connecting one such passageway to at least one other. The passageway constituting the back of the heat exchanger core has an enlarged internal surface area relative to the passageway constituting the face of the heat exchanger core. Microgrooving of the passageway can be used to further enhance heat transfer.

10 Claims, 4 Drawing Sheets

MULTIPLE SERPENTINE TUBE HEAT EXCHANGER

This is a continuation-in-part of U.S. patent application Ser. No. 07/369,891 filed June 22, 1989 now abandoned.

TECHNICAL FIELD

This invention relates to serpentine tube heat exchangers and more particularly to nesting of two or more serpentine-shaped tubes which each contain a side-by-side arrangement of two or more tube passageways, which themselves may be individual tubes or a unitary subdivided part, such as a multiport extrusion.

BACKGROUND OF THE INVENTION

As is well known, the evaporator in an air conditioning system functions with other parts of the system to take heat out of incoming air and provide cool, dehumidified air delivery. For example, in a motor vehicle air conditioning system, refrigerant is typically circulated through the components of the system picking up heat from the incoming passenger compartment air at low pressure in the evaporator and giving off heat outside the passenger compartment at the condenser at high pressure. Evaporator cores are made in various types of materials and construction. One common type of construction for motor vehicle use is called a "plate and fin", so named for the plates that form the fluid passes in the exchanger. Another type of construction is called a "serpentine", so named for the winding shape of its tube(s). It is the latter which is currently receiving renewed interest for use in the motor vehicle industry.

In the typical serpentine tube heat exchanger, there is a single flat sided tubular aluminum extrusion that is bent into the serpentine shape with fittings then provided on the ends for refrigerant inlet and outlet flow. Corrugated fins are inserted between adjacent straight sections of the tubes for heat conduction from the air to the refrigerant with the fin height set by the minimum bend radius of the tubular extrusion.

In such serpentine tube evaporators, the heat transfer is limited mainly due to a high refrigerant side resistance to flow (pressure drop) due to the length of the flow path being the length of the serpentine tube. The pressure drop causes the average refrigerant saturation pressure and temperature to be higher than in an evaporator where the average pressure is closer to the outlet pressure. In a motor vehicle air conditioning system, the evaporator outlet pressure is the controlling factor and an evaporator where the average core pressure is closer to the outlet pressure will have a lower refrigerant temperature and hence better performance. Furthermore, the air flow entering a typical motor vehicle evaporator is not uniformly distributed across the core face due to the tortuous air path in the heating, ventilating and air conditioning system. And this results in an unbalanced heat transfer rate where split circuits across the core face are employed as one circuit will have insufficient liquid refrigerant and cause reduced overall performance.

The conventional serpentine tube evaporator also typically suffers from low performance due to the lack of mixing of the refrigerant in the tubular passages as it flows through the core. Evaporative heat transfer is more efficient than sensible heat transfer and the refrigerant entering the core near the edge of the extruded tube nearest the hot entering air tends to vaporize sooner than refrigerant flowing near the cool air exiting edge. Thus, there is vapor flowing through the core at the front edge without any source of refrigerant liquid available for additional evaporation. Likewise, at the rear edge where the liquid is flowing, there is insufficient heat coming into the tube at that point to promote evaporation. Movement of the liquid refrigerant to the hotter tube areas to the cooler areas is not normally possible because of structural webs normally formed in the extruded tube. Furthermore, where there are split circuits across the core face, there may be unevaporated liquid at the split that is not made uniformly available to the different downstream tube paths. And this early maldistribution of liquid refrigerant in the flow path can cause a substantial loss in performance of an entire half of the core with maldistributed air flow.

SUMMARY OF THE INVENTION

The present invention is directed to a multiple serpentine tube heat exchanger that offers better mixing and an average core pressure close to the outlet pressure thereby collectively enhancing the heat exchanger's performance. This is accomplished by arranging at least two serpentine tube passageways side-by-side and having a mixing chamber connect the one tube passageway on the upstream side to the other tube passageway(s) that are there behind. The side-by-side passageways can be individual tubes or sections of a single unitary part such as an extrusion. The mixing chamber is thus located part way along the refrigerant flow path and allows liquid and vapor refrigerant to mix before continuing through the backside of the serpentine core and with resultantly reduced refrigerant pressure drop. Moreover, additional serpentine-shaped tubes can be nested within the first such arrangement to form a single core offering multiple parallel passageways for the refrigerant flow to and from the mixing chamber, this latter feature having the effect of even further reducing refrigerant pressure drop.

Moreover, it will be appreciated that the refrigerant is thus directed to flow along the front of the core and mix and then flow along the back of the core thus exposing all the core face to a more uniformly cool refrigerant. This effectively provides more opportunity for exposure of liquid refrigerant for evaporation. It will also be appreciated that there may be provided an unequal refrigerant flow split as the open areas of the front and back passageways may be different. For example, in the preferred embodiment there is a single pass across the front but effectively a double pass across the rear with the latter thus providing greater flow area for vapor than for the much denser liquid-dominant refrigerant flow across the front of the core. Again this effectively reduces the pressure drop. Moreover, it will be demonstrated in the preferred embodiment that the inlet and outlet fittings may be on the same face of the core for convenience of assembly in the system. In addition, the heat exchange efficiency is even further enhanced by different special interior configurations in the front and rear tubes best suited to the state of the refrigerant therein, i.e., liquid versus gas.

These and other objects, advantages and features of the present invention will become more apparent from the following description and drawing in which:

Figure 1:
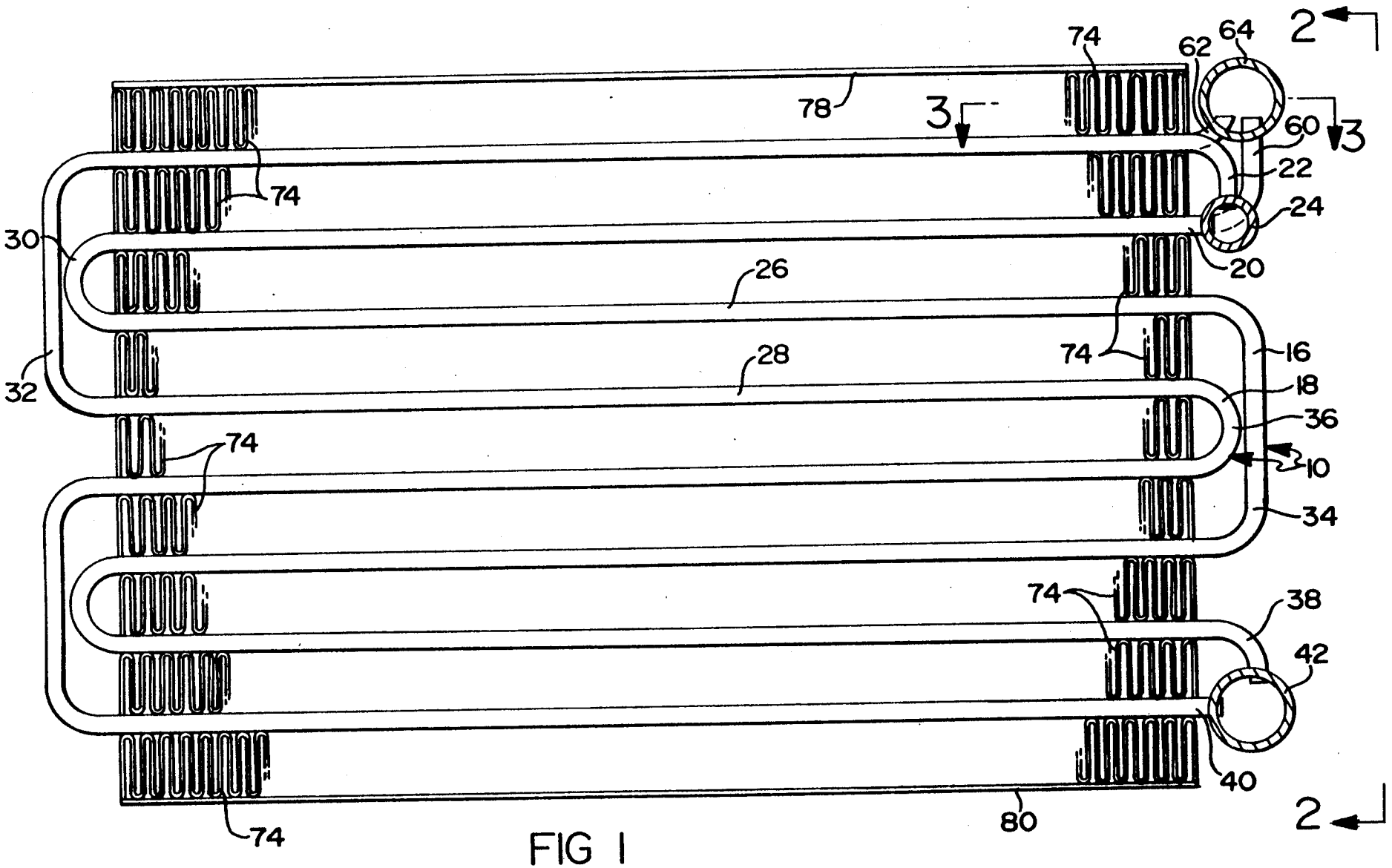
FIG. 1 is a diagrammatic front view of the preferred construction of the multiple serpentine tube heat exchanger according to the present invention.
Figure 2:
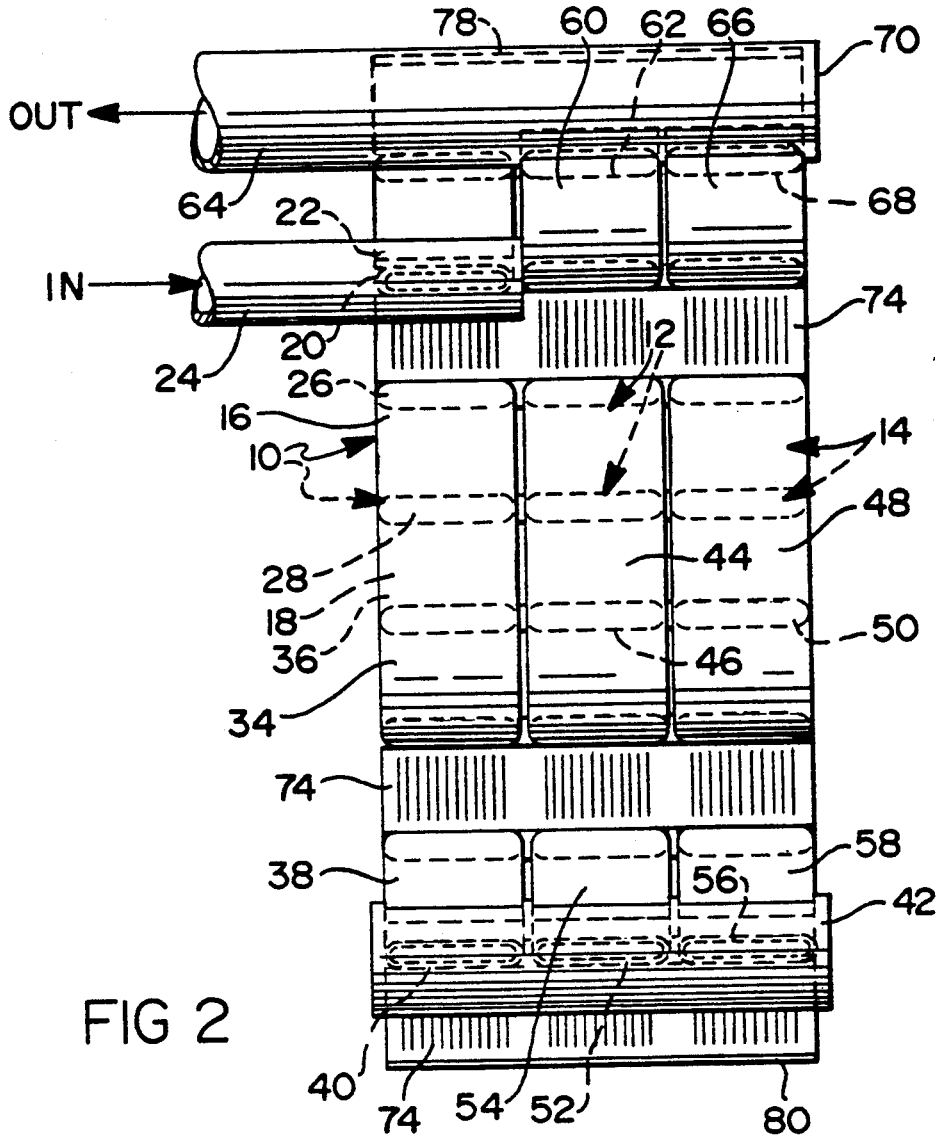
FIG. 2 is a view taken on the line 2—2 in FIG. 1.
Figure 3:
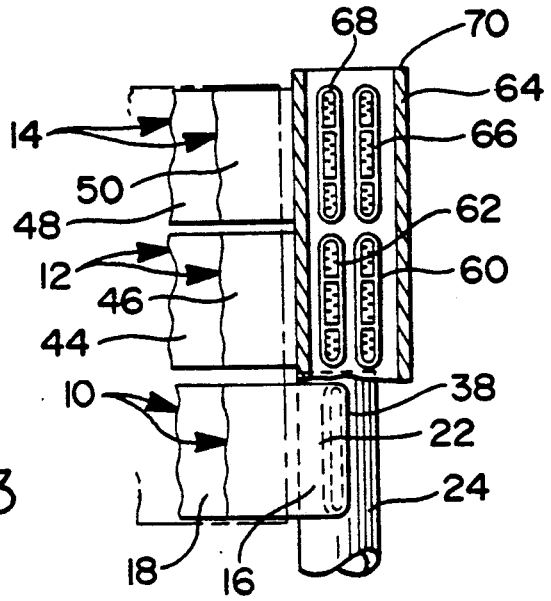
FIG. 3 is a view taken on the line 3—3 in FIG. 1.

DETAILED DESCRIPTION OF THE PREFERRED EMBODIMENT shown in the drawing is adapted for use as an evaporator in a motor vehicle air conditioning system and comprises three pairs of nested tube passageways 10, 12 and 14 arranged side-by-side. Individual tube passageways 16 and 18 which comprise the pair 10 are nested with each other and extend across the face or front side of the core so as to be the first exposed to incoming passenger compartment air. The tubes 16 and 18 are connected at one end 20 and 22 respectively to a tubular inlet fitting 24 arranged at the right hand side of the core. The inlet fitting 24 extends transversely and forwardly of the core for connection in the air conditioning system through an expansion device to the outlet of a condenser (both of which are not shown). The two tube passageways 16 and 18 wind back and forth across the face of the evaporator along long straight sections 26 and 28 and alternately relatively short and long return bends 30 and 32 and 34, 36 and terminate with juxtaposed ends 38 and 40 respectively where they are connected to a tubular mixing chamber 42 that extends transversely across the depth of the core and is closed at its opposite ends.

Tube passageways 44 and 46 comprising the pair 12 and tube passageways 48 and 50 comprising the remaining third pair 14 are similarly nested and wind back and forth across the core in side-by-side relationship with each other and with the nested pair 12 located intermediate of or sandwiched by the other two nested pairs 10 and 14. The tube passageways 44 and 46 of the intermediate nested pair 12 have their respective juxtaposed one end 52 and 54 connected to the mixing chamber 42. And similarly, the tube passageways 48 and 50 in the rearward most nested pair 14 have their respective juxtaposed one end 56 and 58 also connected to the mixing chamber 42.

The tube passageways 44 and 46 in the intermediate nested pair 12 are connected at their respective opposite end 60 and 62 to a tubular outlet fitting 64 that extends transversely the depth of the core and side-by-side with the inlet fitting 24 and outwardly from the core face so as to be adapted to readily connect in the air conditioning system to the inlet of a compressor (not shown). And similarly, the nested serpentine tube passageways 48 and 50 in the rearward most nested pair 14 have their respective juxtaposed other end 66 and 68 connected to the outlet fitting 64 near to its closed rearward end 70.

All the tube passageways have substantially the same length and an oval flat sided cross section and the core assembly is completed by fins formed of corrugated and louvered strips 74 which are inserted between adjacent long sections 26 and 28 of the tube passageways in each nested pair and are bonded to their flat sides. In addition, reinforcement strips 78 and 80 are bonded to the outboard side of the two outboard fins to protect the core assembly as well as strengthen same. The tubes, fittings, fins and reinforcement strips are all made of aluminum and either all clad or selectively clad with a conventional braze material and bonded by brazing in a conventional manner.

Figure 4:
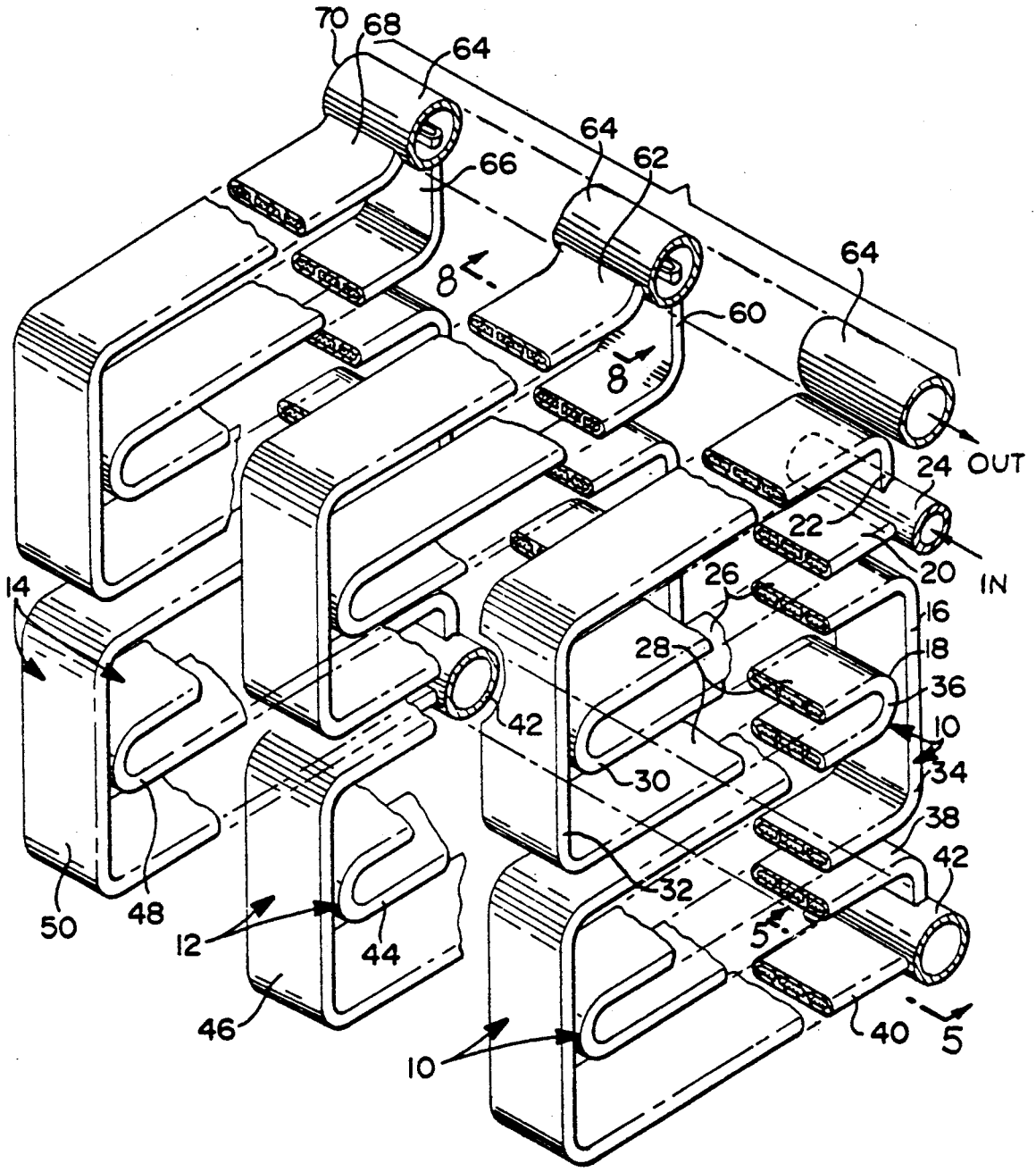
FIG. 4 is a three-dimensional diagrammatic view of the heat exchanger in FIG. 1.

Describing now the operation of the evaporator, refrigerant which is mainly in liquid form at low pressure enters the inlet fitting 24 and divides between the two serpentine tube passageways 20 and 22 on the front side of the evaporator. The incoming refrigerant thus passes along parallel passageways across the front face of the core to the mixing chamber 42 which parallel passageways have the effect of reducing the pressure drop. However, it will also be understood while two parallel passageways across the face have been shown, there may be only one such passageway or there may be more additional parallel passageways. The refrigerant that flows along the front of the core then mixes in the mixing chamber 42 and flows along the back of the core thus exposing all of the core face to a more uniformly cool refrigerant. Moreover, refrigerant on the back side is split at the mixing chamber between the two nested pairs 12 and 14 as it flows in parallel relationship to the outlet fitting 64. In other words, there is an unequal refrigerant split between that going to and coming from the mixing chamber with the flow area of the latter having been chosen to provide greater flow area for vapor than for the much denser liquid-dominant refrigerant that flows across the front face of the evaporator. Moreover, it will be appreciated that by bending the ends 20, 22 of the front serpentine tubes 10 in opposite directions to those ends 60, 62 and 66, 68 of the respective rear tubes 12 and 14 as seen in FIG. 4 allows both inlet and outlet fittings 24 and 64 to be on the same face of the evaporator for ease and assembly of the evaporator in a confined space such as that found in a motor vehicle. Furthermore, it will be seen that such fittings are simply straight tubular sections rather than requiring complicated bends and routing to make connection in the air conditioning system.

Figure 5:
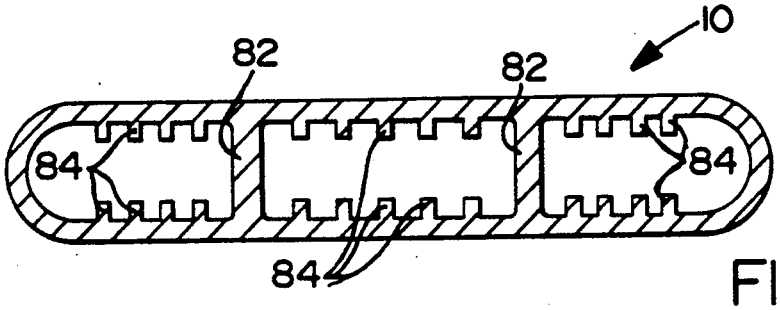
FIG. 5 is an enlarged sectional view taken along the line 5—5 in FIG. 4.
Figure 6:
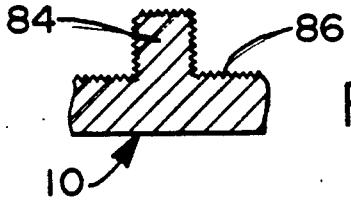
FIG. 6 is an enlarged partial view of the tube cross section in FIG. 5 but with a modified internal surface.
Figure 7:
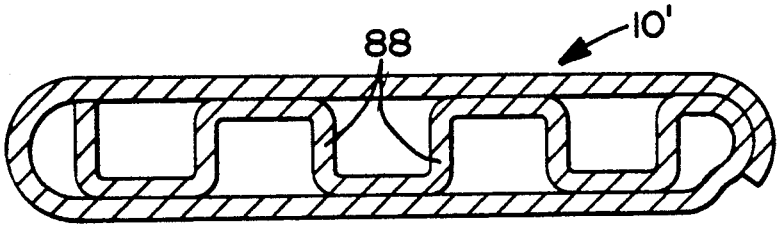
FIG. 7 is a view like FIG. 5 but of another embodiment of the tube's cross section.

The heat exchange efficiency is further enhanced by the formation of internal ribs and finned channels in the interior of the tube passageways to increase heat transfer area and/or create helpful turbulence. Furthermore, such enhancement is made differently in the front and back split with that in the front specially suited to a higher fraction of liquid refrigerant and that in the rear specially suited to a predominately gaseous refrigerant flow. This is accomplished by the interior tube configurations shown in FIGS. 5–9. For the predominately liquid flow the front tubes 10 have, as seen in FIG. 5, two extruded spans 82 between the flat sides for resisting internal pressure and a plurality of extruded short ribs 84 extending inward from the flat sides intermediate the spans that both increase the interior surface area and provide nucleation sites for the boiling of the liquid refrigerant adjacent this increased heat transfer area. The ribs extend no more than about 25% of the spans or open width and are equal in both heighth and width. And for even more heat transfer area, the entire interior of the tube including both the spans and ribs as well as the remaining wall surface may be formed with microgrooves 86 as shown in FIG. 6. The front tubes may also be fabricated from sheet stock as seen in FIG. 7 where they are identified in the one example as 10. In fabricated form, the sheet stock is simply formed with lengthwise corrugations 88 that serve as both the spans and ribs in the FIG. 5 embodiment. And like in FIG. 6, the corrugations and the remaining interior of the fabricated tubes 10, could be formed with a microgroove surface for even greater heat transfer surface on the refrigerant side.

Figure 8:
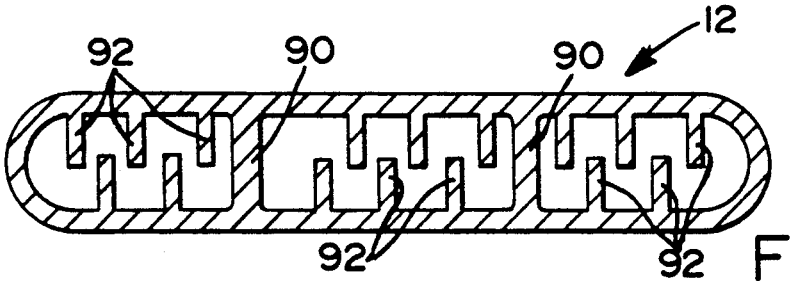
FIG. 8 is an enlarged sectional view taken along the line 8—8 in FIG. 5.
Figure 9:
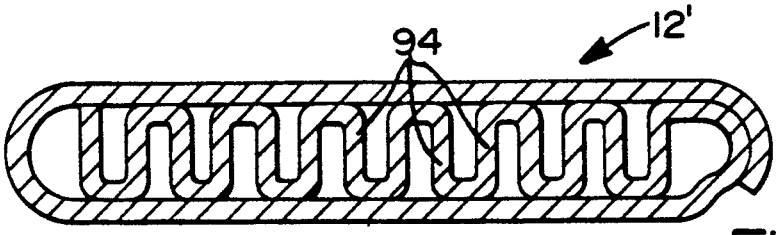
FIG. 9 is a view like FIG. 8 but of another embodiment of the tube's cross section.

For heat transfer enhancement on the predominately gaseous refrigerant or rear side of the core, the two sets of rear tubes 12 and 14 also have as seen in FIG. 8 two extruded spans 90 for strength and a plurality of extruded ribs 92 like the front tubes but in this case the ribs 92 extend about 75% across the passage overlapping and extending adjacent to these on the other side for even more increase in heat transfer area as compared with FIG. 5. The ribs 92 do not extend completely across the passage so that paths remain for distribution of the predominately gaseous refrigerant laterally within the passage to help achieve uniform distribution of any remaining liquid refrigerant. The ribs 92 are taller than they are wide and it will be understood that microgrooving may be added to the tube walls but not to the ribs as it has little benefit in the gaseous flow and would restrict same. The rear tubes may like the front tubes also be fabricated from sheet stock as seen in FIG. 9 where they are identified in the one example as 12'. Like the FIG. 7 embodiment, spans are formed by lengthwise corrugations 94 but in greater number (closer spaced) for increased surface area suited to the predominately gaseous flow on the rear side of the core. Moreover, selectively closed louvers on the fins may also be beneficial particularly with tall fins to close off sides of the air passages.

The foregoing description of the preferred embodiment of the invention has been presented for purposes of illustration and description. It is not intended to be exhaustive or limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

The embodiments of the invention in which an exclusive property or privilege is claimed are defined as follows:

1. An evaporator for a refrigeration system having a face toward which air is directed and a back from which the air exits and comprising at least two serpentine shaped tube passageways with substantially the same cross-sectional outline arranged side-by-side so that one of said passageways is ahead of the other relative to air flow therepast and solely constitutes the face of the evaporator and said other passageway solely constitutes the back of the evaporator, said one passageway having an inlet and outlet located at one side of the evaporator, said other passageway having an inlet and outlet located at said one side of the evaporator, an inlet fitting connected to said inlet of said one passageway, a mixing chamber connected to said outlet said one passageway and to the inlet of said other passageway so that said mixing chamber is connected between said face and back of the heat exchanger, an outlet fitting connected to the outlet of said other passageway, said one passageway having an internal surface area suited to predominately liquid refrigerant flow, and said other passageway having internal area enlarging means providing substantially more internal surface area than said one passageway for effecting enhanced heat transfer with predominately gaseous refrigerant flow in said other passageway.

2. The evaporator set forth in claim 1 wherein said inlet and outlet fittings extend side-by-side in the same direction form said face of the evaporator.

3. The evaporator set forth in claim 1 and at least two additional serpentine shaped tube passageways arranged side-by-side in nesting relationship with said first mentioned two passageways respectively, said additional passageways connected to said fittings and said mixing chamber the same as the respective passageways with which they nest, said two additional passageways having the same internal surface area relationship as said first mentioned two passageways.

4. The evaporator set forth in claim 1 and said passageways having substantially the same length.

5. The evaporator set forth in claim 1 wherein said side-by-side passageways comprise a unitary multiport extruded part.

6. The evaporator set forth in claim 1 wherein said passageways are extruded tubes and said internal area enlarging means comprises internal spans and ribs in said tubes that define the internal surface and are relatively sized to make the internal surface area of said other passageway larger than that of said one passageway.

7. The evaporator set forth in claim 1 wherein said passageways are fabricated tubes and said internal area enlarging means comprises internal corrugations in said tubes that define their internal surface and are relatively spaced to make the internal surface area of said other passageway larger than that of said one passageway.

8. The evaporator set forth in claim 6 or 7 wherein the internal surface of only said one passageway has microgrooves for enhancing heat transfer with liquid refrigerant flow.

9. The evaporator set forth in claim 1 wherein there is a third passageway connected in parallel with said other passageway between said mixing chamber and said outlet fitting and located between the said one and other passageways, said third passageway also having substantially more internal surface area than said one passageway for effecting enhanced heat transfer with predominately gaseous refrigerant flow in said other passageway.

10. The evaporator set forth in claim 9 wherein said three passageways are of equal length.

* * * * *